US007375700B2

(12) United States Patent
Hwang et al.

(10) Patent No.: US 7,375,700 B2
(45) Date of Patent: May 20, 2008

(54) WIDEBAND MONOPOLE ANTENNA

(75) Inventors: Seong-Taek Hwang, Pyeongtaek-si (KR); Jae-Hoon Lee, Seoul (KR); Young-Sik Kim, Seoul (KR); Ji-Chai Jeong, Seoul (KR); Jung-Woo Baek, Seoul (KR); Young-Je Sung, Seoul (KR)

(73) Assignee: Samsung Electronics Co., Ltd., Yeongtong-Gu, Suwon-Si, Gyeonggi-Do (KR)

( * ) Notice: Subject to any disclaimer, the term of this patent is extended or adjusted under 35 U.S.C. 154(b) by 219 days.

(21) Appl. No.: 11/230,971

(22) Filed: Sep. 20, 2005

(65) Prior Publication Data

US 2006/0181463 A1 Aug. 17, 2006

(30) Foreign Application Priority Data

Feb. 17, 2005 (KR) ..... 10-2005-0013133

(51) Int. Cl.
*H01Q 1/50* (2006.01)
*H01Q 1/24* (2006.01)

(52) U.S. Cl. ..... 343/906; 343/702

(58) Field of Classification Search ..... 343/702, 343/872, 906

See application file for complete search history.

(56) References Cited

U.S. PATENT DOCUMENTS 6,157,344 A * 12/2000 Bateman et al. ..... 343/700 MS
6,774,853 B2 * 8/2004 Wong et al. ..... 343/700 MS

* cited by examiner

*Primary Examiner*—Shih-Chao Chen
(74) *Attorney, Agent, or Firm*—Cha & Reiter, LLC

(57) ABSTRACT

A wideband monopole antenna assembly includes a substrate having an antenna connector, a wideband monopole antenna positioned on the substrate, and a feeder unit positioned on the rear surface of the substrate for supporting the antenna with a part thereof bent at a predetermined angle. The wideband monopole antenna has a feeder portion shorter than conventional antennas for compactness of the antenna.

19 Claims, 8 Drawing Sheets

Radiation Pattern [800 MHz]

Radiation Pattern [800 MHz]

Radiation Pattern [1.6GHz]

Radiation Pattern [1.6GHz]

Radiation Pattern [2.4GHz]

Radiation Pattern [2.4GHz]

WIDEBAND MONOPOLE ANTENNA

CLAIM OF PRIORITY

This application claims priority to an application entitled "Wideband Monopole Antenna," filed with the Korean Intellectual Property Office on Feb. 17, 2005 and assigned Serial No. 2005-13133, the contents of which are incorporated herein by reference.

BACKGROUND OF THE INVENTION

1. Field of the Invention

The present invention relates to a wideband monopole antenna, and more particularly to a wideband monopole antenna having a feeder unit bent at a predetermined angle.

2. Description of the Related Art

Portable communication apparatuses, such as HHPs, CT-2 cellular phones, smart phones, digital phones, PCS phones, PDAs, and laptop computers, are becoming smaller and have multi-functionality. In addition to voice communication and radio listening capabilities, they are now equipped to access the Internet and download MP3 music clips. Various information and images in the form of digitalized data can be also easily accessed using portable devices. Such information is band-compressed using audio or video technology and can be easily and effectively transmitted via digital radio communication or digital radio broadcasting.

Current technological trend demands a rapid increase in new services which require a larger capacity and more bandwidths. As a result, the cost associated with the provision of new base stations and repeaters to accommodate modem devices is increasing. One way to accommodate the new demand is to provide a wideband antenna satisfying a bandwidth of 0.7 GHz-2.5 GHz. A typical example of a multiple wideband antenna is a UWB (ultra-wideband) antenna.

In using multiple UWB antenna, the most critical issues relate to improving the antenna efficiency and reducing an electromagnetic absorption ratio. The UWB antennas usually use pulses having a width of 1 nsec or less to transmit information, instead of RF carrier waves. Since a power spectrum as low as baseband noise exists over a wide band due to the property of the pulses, the UWB antennas can perform transmission without any interference from other radio communication systems currently being used. Further, they have a wider bandwidth and a larger transmission speed than the conventional antennas.

Moreover, the UWB antennas using very short pulses can distinguish both signals even when there is a difference in the path reaching between the direct and reflected waves. As such, they are suitable for use in multiple paths and able to obtain an accuracy in the unit of cm using the resolution of short pulses. They have excellent obstacle penetration characteristics due to wideband characteristics, thus can be easily integrated as inground penetration radars and position tracking systems. However, the UWB antennas must be compact and light to be mounted on the terminals, while meeting the performances required as expected in the UWB systems.

FIGS. 1 and 2 show a conventional monopole antenna. As shown, a monopole antenna 3 is provided with a Y-type feeder line 4 on the rear surface of a substrate 1, which is provided with a ground surface 2, and electrically connected to a connection unit 3*a* of the antenna. The substrate 1 has an antenna connector 5 connected to the Y-type feeder line 4.

When the monopole antenna has a Y-type feeder line on the rear surface of the substrate, however, the substrate 1 and the radiator must be enlarged to accommodate the size of the feeder line, thus increasing the overall size of the antenna.

In addition, the Y-type feeder line is typically made of a flexible wire and has no support force. When the contour of the antenna vibrates severely due to an external impact (e.g., wind or shock), the contact portion of the feeder line vibrates together. As a result, the radiation characteristics and matching band of the antenna can be easily varied and the function of the antenna may deteriorate. However, if the feeder portion is shortened to reduce the size of the antenna, the bandwidth decreases.

SUMMARY OF THE INVENTION

Accordingly, the present invention has been made to solve the above-mentioned problems occurring in the prior art and provides additional advantages, by providing a wideband monopole antenna having a feeder unit bent at a predetermined angle to be connected to the antenna.

One aspect of the present invention is to provide a wideband monopole antenna having a feeder portion that is shorter than conventional antennas.

Another aspect of the present invention is to provide a wideband monopole antenna having a feeder unit made of a metallic material in order to improve the support force of the antenna and to prevent the antenna from vibrating.

In one embodiment, there is provided a wideband monopole antenna assembly including a substrate having an antenna connector, a wideband monopole antenna disposed on the substrate, and a feeder unit positioned on the rear surface of the substrate to support the antenna with a part thereof bent at a predetermined angle.

BRIEF DESCRIPTION OF THE DRAWINGS

The above features and advantages of the present invention will be more apparent from the following detailed description taken in conjunction with the accompanying drawings, in which.

DETAILED DESCRIPTION

Hereinafter, an embodiment of the present invention will be described with reference to the accompanying drawings. For the purposes of clarity and simplicity, a detailed description of known functions and configurations incorporated herein is omitted to avoid making the subject matter of the present invention unclear.

Figure 1:
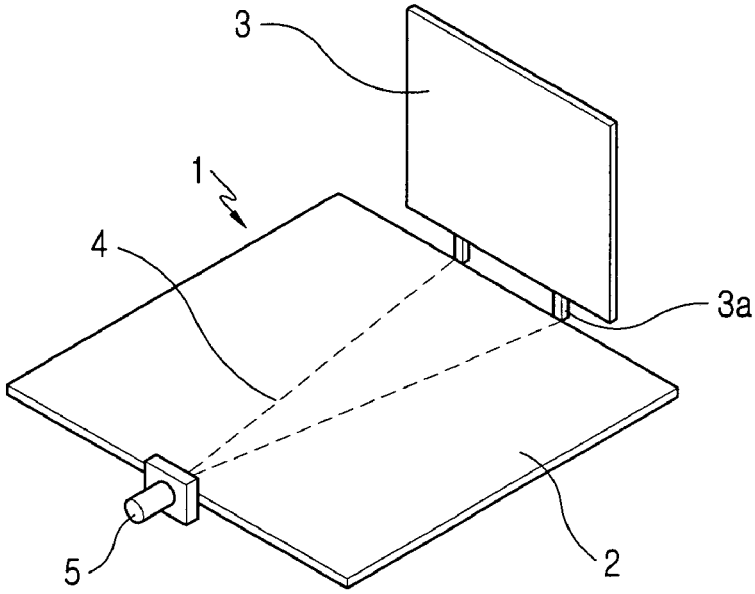
FIG.1 (PRIOR ART)
FIG. 1 shows a conventional monopole antenna.
Figure 2:
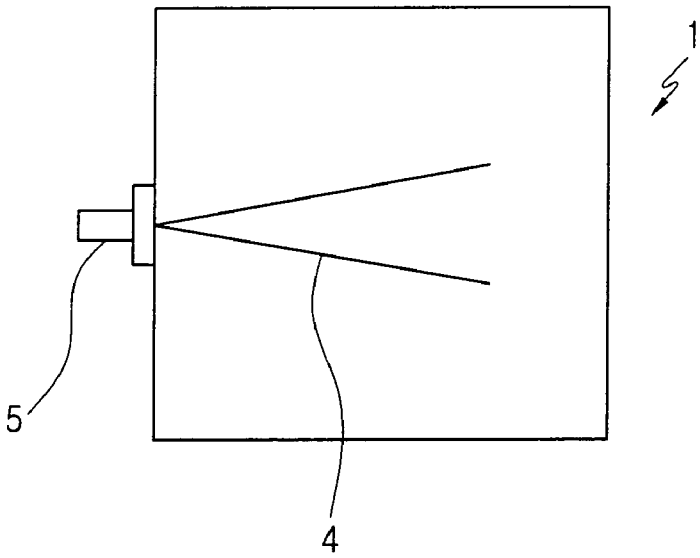
FIG.2 (PRIOR ART)
FIG. 2 shows a bottom view of a Y-type feeder line of the conventional monopole antenna.
Figure 3:
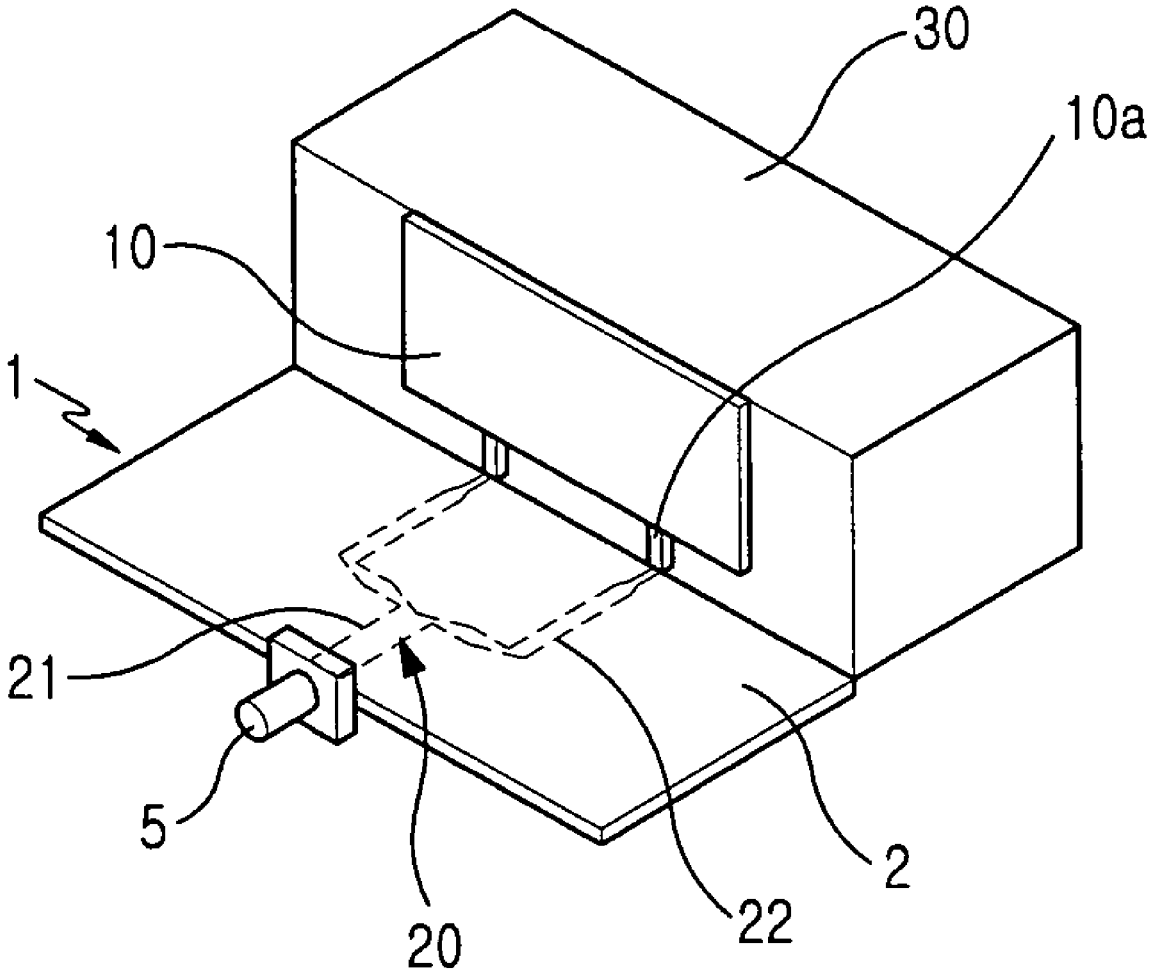
FIG. 3 is a perspective view showing the construction of a wideband monopole antenna according to an embodiment of the present invention.
Figure 4:
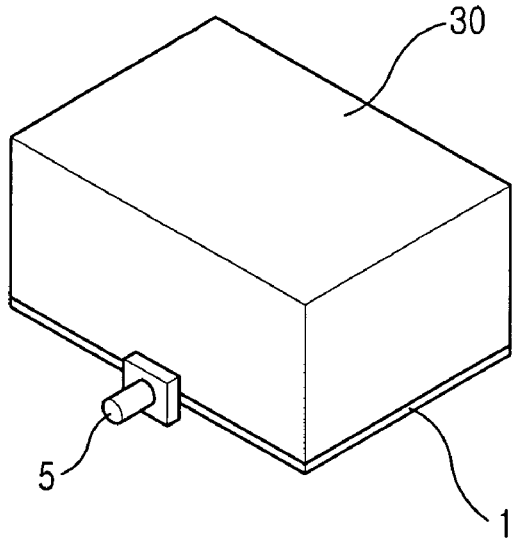
FIG. 4 is a perspective view showing a wideband monopole antenna, in a coupled state, according to an embodiment of the present invention.

Referring to FIGS. 3 and 4, a wideband monopole antenna 10 having a rectangular shape is disposed on a substrate 1 having a ground surface 2. The top of the antenna 10 is enclosed by a dielectric body 30, and the antenna 10 has a dielectric constant of at least 1. A feeder unit 20 is positioned at a rear surface of the substrate 1 to support the antenna 10 with a part thereof bent at a predetermined angle and is electrically coupled to the antenna 10. The feeder unit 20 is made of a metallic material.

Figure 5:
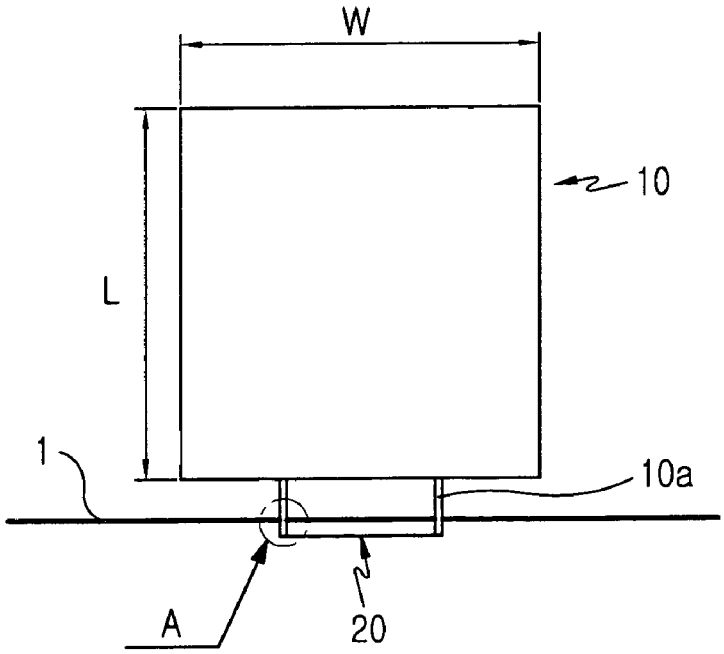
FIG. 5 is a front view showing the construction of a wideband monopole antenna according to an embodiment of the present invention.
Figure 6:
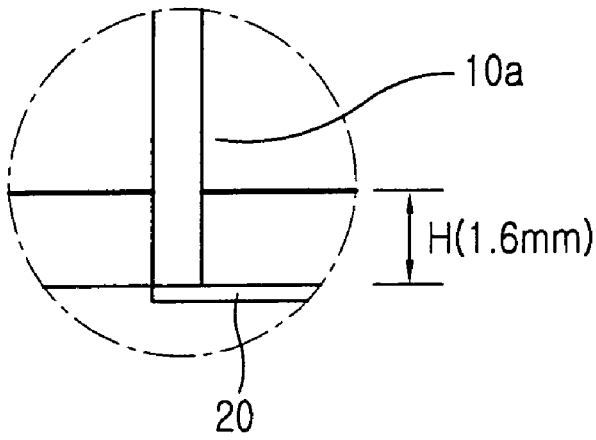
FIG. 6 is a front view magnifying part A of FIG. 5.
Figure 7:
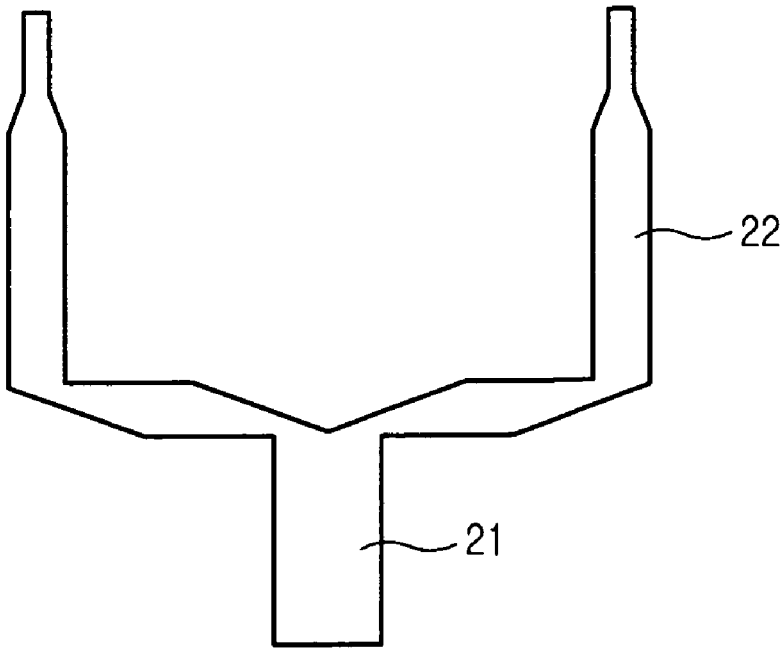
FIG. 7 illustrates a feeder unit of a wideband monopole antenna according to an embodiment of the present invention.

Referring to FIGS. 5, 6, and 7, the feeder unit 20 is electrically coupled to the antenna 10 and includes first and second connection support pieces 21 and 22. The first connection support piece 21 is coupled to an antenna connector 5 provided on the substrate 1, and the second connection support piece 22 is coupled to a connection unit 10*a* of the antenna 10. At least one second connection support piece 22 is bent at 90° from the body of the feeder unit 20. The feeder unit 20 maintains a constant resonance height H of the antenna 10. The resonance height H is 1.6 mm.

Now, the teachings of a wideband monopole antenna according to an embodiment of the present invention, configured as above, will now be described in more detail with reference to FIGS. 3 to 14.

As shown in FIG. 3, a feeder unit 20 is positioned at a rear surface of a substrate 1, and a monopole antenna 10 is disposed on top of the substrate 1. Further, a dielectric body 30 is positioned behind the monopole antenna 10. As shown in FIG. 4, the dielectric body encloses the monopole antenna 10. To achieve this, the dielectric body 30 and the antenna 10 are rotated toward the antenna connector 5 and coupled to the ground surface of the substrate 1.

As shown in FIGS. 3 and 7, the feeder unit 20 has a first connection support piece 21 formed at one end thereof to be coupled to an antenna connector 5, which is provided on the substrate 1. The feeder unit 20 has at least one second connection support piece 22 formed at the other end thereof to be electrically coupled to a connection unit 10*a* of the antenna 10.

As the antenna's height affects the frequency, the length L of a radiation device of the antenna 10 determines the lowest and highest frequency of the bandwidth. For example, if the height of the antenna is short, the lower frequency of a bandwidth is obtained than if the height of the antenna is long. Here, the lowest frequency is between 800 MHz~2.4 GHz, and the highest frequency is at least 2.4 GHz. Thus, the total height of the antenna 10 according to the present invention is slightly shorter than a quarter of the wavelength of the lowest frequency.

The feeder unit 20 is positioned below the ground surface 2 of the substrate 1. The distance between the ground surface 2 and the feeder unit 20 is referred to as a resonance height H, which serves to provide a radiation structure with a purely vertical current, while avoiding a horizontal current that distorts the impedance bandwidth and the radiation characteristics of the antenna 10.

As shown in FIG. 5, the antenna 10 has three resonance points by means of the first and second connection support pieces 21 and 22, which are very sensitive to the resonance height H of the antenna 10. In addition, unlike the length L or width W of the antenna 10, these three resonance points affect the lowest and highest frequencies of the bandwidth.

Figure 8:
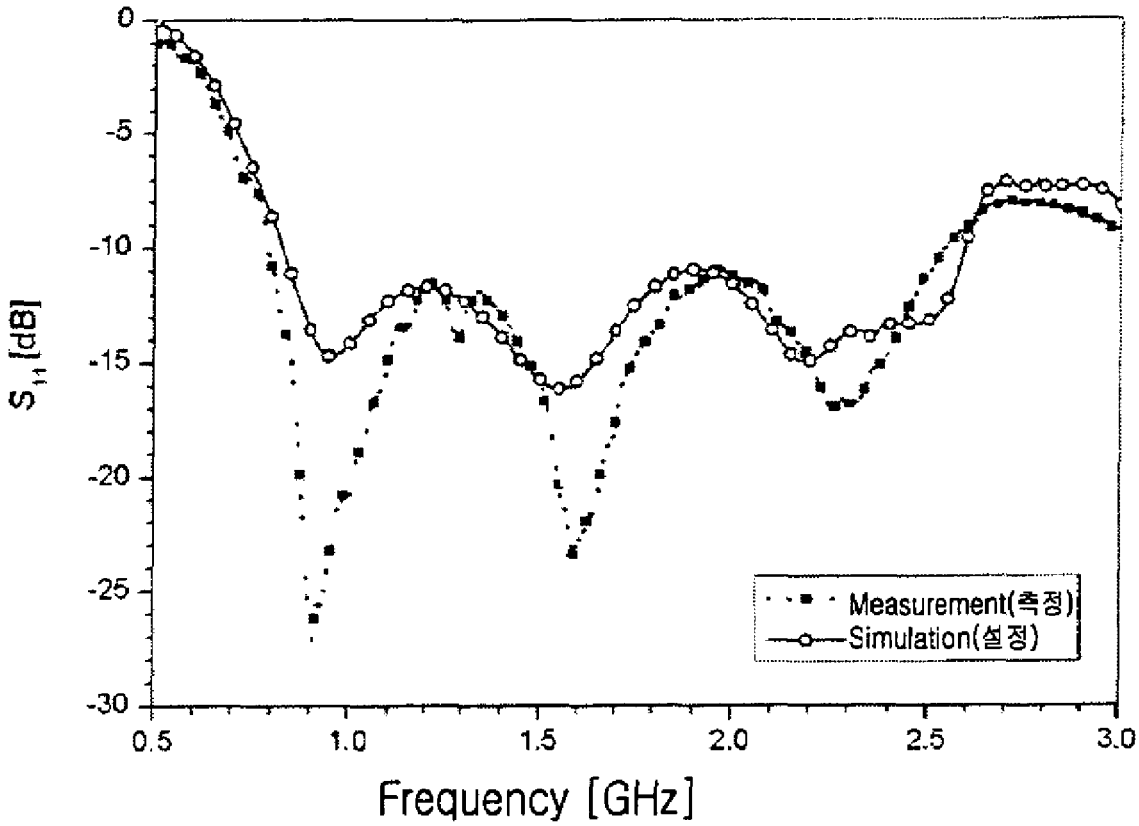
FIG. 8 shows the reflection coefficient characteristics of a wideband monopole antenna according to an embodiment of the present invention.

Referring to FIG. 8, although the lowest frequency at the impedance bandwidth decreases according to the resonance height H, the highest frequency also decreases. This doesn't have an affect of improving the bandwidth. Here, the resonance of antenna is performed when the height of the antenna is an integer multiple of a quarter of the wavelength. Hence, the lowest frequency among frequencies is a resonant frequency. In FIG. 8, the lowest frequencies are 0.8 MHz, 1.6 GHz, and 2.4 GHz. The lowest frequency in an impedance bandwidth is decreased according to the resonance height H, and the highest frequency is also decreased at the same time.

The wideband monopole antenna according to the present invention will now be described with regard to radiation patterns at 800 MHz, 1.6 GHz, and 2.4 GHz.

Figure 9:
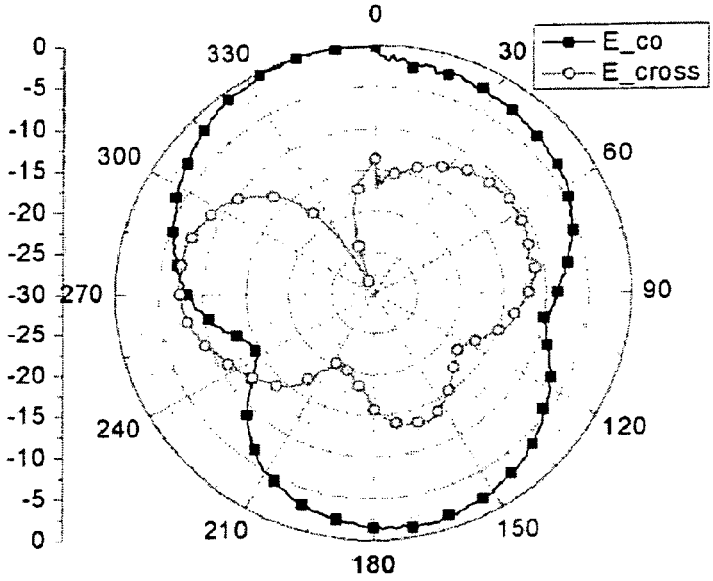
FIG. 9 shows a radiation pattern of an E-field at 0.8 GHz of a wideband monopole antenna according to an embodiment of the present invention.
Figure 10:
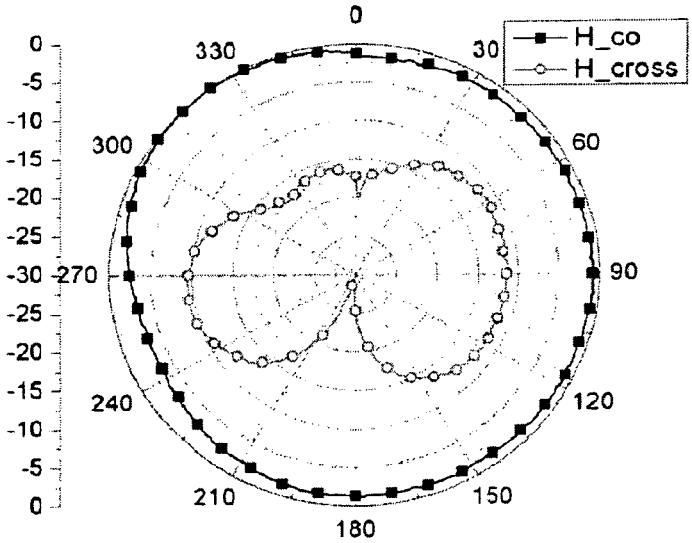
FIG. 10 shows a radiation pattern of an H-field at 0.8 GHz of a wideband monopole antenna according to an embodiment of the present invention.

Referring to FIGS. 9 and 10, in a radiation pattern of an E-field (electric field) at 800 MHz of the monopole antenna 10, the ground surface 2 appears smaller. The radiation pattern is formed around the central ground surface 2 of the antenna, thus the radiation pattern is formed relatively lager than the ground surface 2 so that the ground surface 2 appears smaller than the radiation pattern. This means that radiation is good even behind the ground surface 2. The H-field (magnetic field) establishes all-directional radiation characteristics around the monopole.

Note that in FIGS. 9-14, E-co indicates a deviation of the radiation pattern in the E-field, E-Cross indicates a cross-deviation of the radiation pattern in the E-field.

Figure 11:
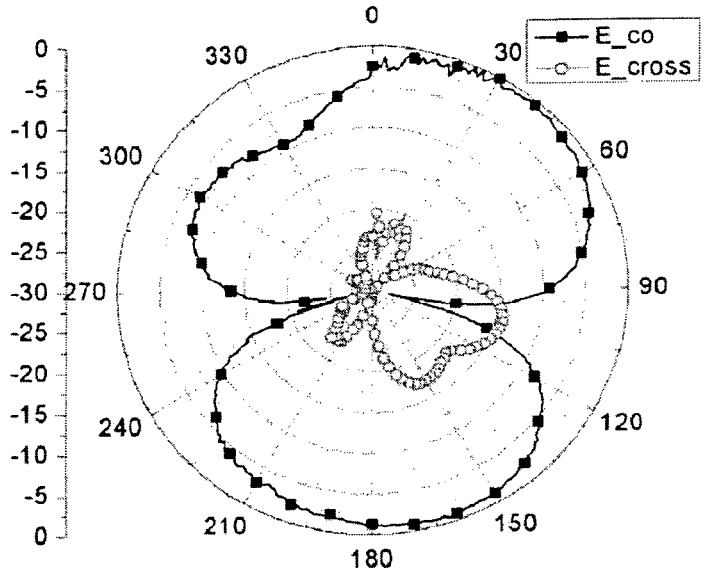
FIG. 11 shows a radiation pattern of an E-field at 1.6 GHz of a wideband monopole antenna according to an embodiment of the present invention.
Figure 12:
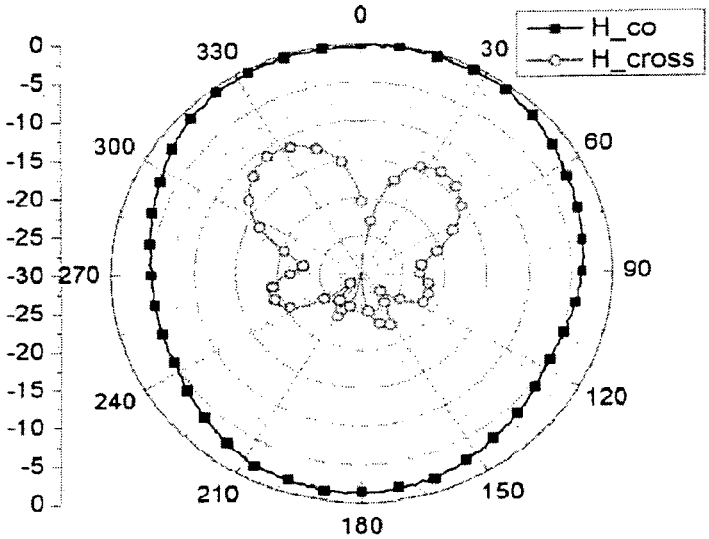
FIG. 12 shows a radiation pattern of an H-field at 1.6 GHz of a wideband monopole antenna according to an embodiment of the present invention.

Referring to FIGS. 11 and 12, in a radiation pattern at 1.6 GHz of the monopole antenna 10, the electrical magnitude in relation to the ground surface 2 increases as the frequency rises. This means that the radiation pattern tends to gradually concentrate on the upper portion of the ground surface 2, and null (0) point occurs at phi=90°. The E-field pattern is deeper than at 800 MHz. Comparing the radiation pattern of the E-field in FIG. 9 with the radiation pattern of the E-field in FIG. 11, the radiation pattern is deeply hollowed at 90 degrees and 270 degrees. That is, "deeper" is obtained from a result of a comparison between the depth of the radiation pattern of FIG. 9 and the depth of the radiation pattern of FIG. 11 at 90 degrees and 270 degrees.

Figure 13:
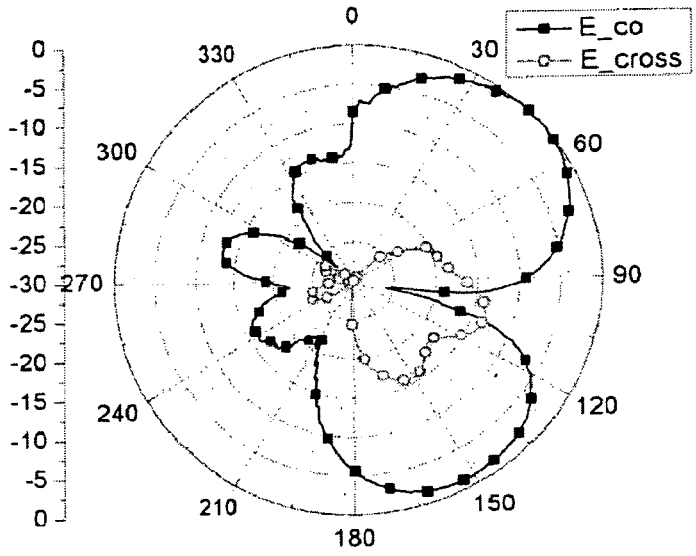
FIG. 13 shows a radiation pattern of an E-field at 2.4 GHz of a wideband monopole antenna according to an embodiment of the present invention.
Figure 14:
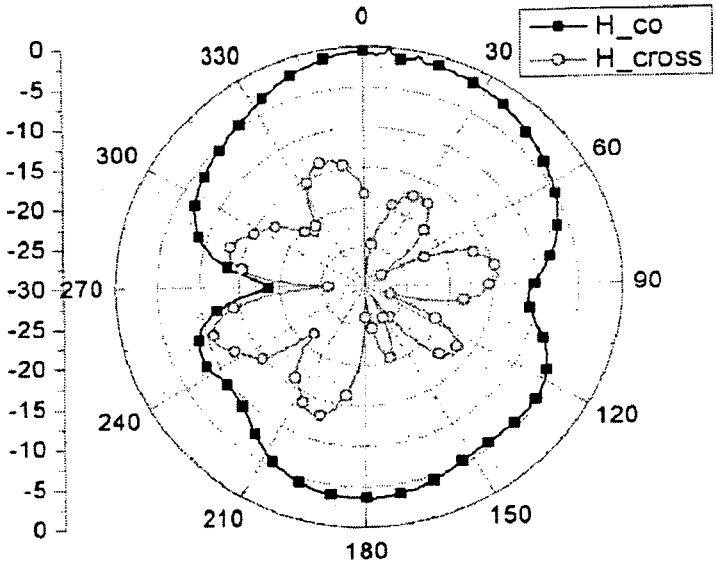
FIG. 14 shows a radiation pattern of an H-field at 2.4 GHz of a wideband monopole antenna according to an embodiment of the present invention.

Referring to FIGS. 13 and 14, in a radiation pattern at 2.4 GHz of the monopole antenna 10, the electrical length of the width W of the antenna 10 appears larger than the wavelength of 2.4 GHz. That is, the radiation pattern at 2.4 GHz is deeply hollowed at 90 degree so that electrical length of the ground surface and the width W of the antenna 10 appear relatively larger than the wavelength of 2.4 GHz. The E-field pattern has characteristics of being radiated to the upper portion of the ground surface 2. In the H-field pattern, null (0) points occur at both ends of the width W of the radiation device.

As is apparent from the foregoing, the planar monopole antenna 10 having a feeder unit 20 with at least one vertical connection support piece 21 and 22 has an impedance bandwidth of 0.8-2.5 GHz, which covers cellular, PCS, and radio LAN (802.11b/g) bandwidths. Although the planar monopole antenna 10 having a rectangular shape has a smaller impedance bandwidth than a circular monopole antenna 10, it has less distortion of radiation patterns within the bandwidth. The T-shaped feeder unit 20 has a very small reactance component throughout a very large impedance bandwidth, so that the structure of T-shaped feeder unit 20 is easy to perform an impedance matching. Here, the reactance means a resistance component which prevents the flow of a current, and the impedance means a value of composition of the resistance and the reactance. i.e., the impedance represents a value of preventing a flow of the current. If the impedance value of the T-shaped feeder unit 20 is set at 50 Ω, an impedance of the antenna should be controlled to be close to 50 Ω. This control is known as an impedance matching. Here, 50 Ω is randomly designated, and it can be designated as over or below 50 Ω. In addition, the radiation loss occurring when positioned below the ground surface 2 can be avoided. The feeder unit 20 is not provided to be lapped over the ground surface 2, which is provided on a substrate 1. The ground surface 2 is provided to a front of the substrate 1, and the feeder unit 20 is provided to a back of the substrate 1 to thereby prevent a collision of the ground surface 2 and the feeder unit 20. Therefore, a constant radiation pattern required in the antenna can be maintained.

The inventive monopole antenna has a feeder unit bent at a predetermined angle to be electrically connected to the antenna, so that the feeder portion is shorter than conventional antennas to achieve a smaller configuration. The feeder unit may be made of a metallic material to improve the support force for the antenna.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A wideband monopole antenna assembly, comprising:

a substrate having an antenna connector;

a wideband monopole antenna disposed on the substrate; and a feeder unit having a main body and at least one end disposed on a bottom surface of the substrate and electrically coupled to the antenna, wherein the feeder unit includes at least a first and second connection feed elements bent at a predetermined angle and substantially parallel to each order.

2. The wideband monopole antenna assembly as claimed in claim 1, wherein the feeder unit has a fork-shaped configuration.

3. The wideband monopole antenna assembly as claimed in claim 1, wherein the feeder unit is made of a metallic material.

4. The wideband monopole antenna assembly as claimed in claim 1, wherein the main body of the feeder unit is coupled to the antenna connector.

5. The wideband monopole antenna assembly as claimed in claim 1, wherein one end of said second feed element is electrically coupled to the antenna.

6. The wideband monopole antenna assembly as claimed in claim 1, wherein the predetermined angle between said first and second feed elements is 90°.

7. The wideband monopole antenna assembly as claimed in claim 1, wherein the feeder unit is configured to maintain a constant resonance height of the substrate and the antenna.

8. The wideband monopole antenna assembly as claimed in claim 7, wherein the resonance height is 1.6 mm.

9. The wideband monopole antenna assembly as claimed in claim 1, wherein a dielectric body is positioned on top of the substrate for enclosing the antenna.

10. The wideband monopole antenna assembly as claimed in claim 9, wherein the dielectric body has a dielectric constant of at least 1.

11. A wideband monopole antenna assembly, comprising:

a substrate;

a wideband monopole antenna; and a feeder unit having a main body and at least one end disposed on a bottom surface of the substrate and coupled to the antenna while maintaining a constant height between the substrate and the antenna, wherein the feeder unit includes at least a first and a second connection feed elements bent at a predetermined angle and substantially parallel to each order.

12. The wideband monopole antenna assembly as claimed in claim 11, wherein the feeder unit is made of a metallic material.

13. The wideband monopole antenna assembly as claimed in claim 11, wherein the main body of the feeder unit is coupled to the antenna connector.

14. The wideband monopole antenna assembly as claimed in claim 11, wherein one end of said second feed element is electrically coupled to the antenna.

15. The wideband monopole antenna assembly as claimed in claim 11, wherein the predetermined angle between said first and second feed elements is 90°.

16. The wideband monopole antenna assembly as claimed in claim 11, wherein the feeder unit is configured to maintain a constant resonance height of the substrate and the antenna.

17. The wideband monopole antenna assembly as claimed in claim 16, wherein the resonance height is 1.6 mm.

18. The wideband monopole antenna assembly as claimed in claim 11, wherein a dielectric body is positioned on top of the substrate for enclosing the antenna.

19. The wideband monopole antenna assembly as claimed in claim 18, wherein the dielectric body has dielectric constant of at least 1.

* * * * *